US005848939A

United States Patent [19]

Smith

[11] Patent Number: 5,848,939

[45] Date of Patent: Dec. 15, 1998

[54] RODEO GAME SYSTEM

[76] Inventor: James R. Smith, 5561 Harvest Hill Rd., Apt. 1136, Dallas, Tex. 75230

[21] Appl. No.: 902,541

[22] Filed: Jul. 22, 1997

Related U.S. Application Data

[60] Provisional application No. 60/022,323 Jul. 24, 1996.

[51] Int. Cl.[6] ..... A63G 31/16

[52] U.S. Cl. ..... 472/60; 472/97; 472/103

[58] Field of Search ..... 472/59, 60, 61, 472/95, 96, 97, 98, 99, 103, 104, 105; 463/7, 36; 273/148 B; 434/29, 55, 61, 62, 65

[56] References Cited

U.S. PATENT DOCUMENTS

| | | | |
|---|---|---|---|
| 1,960,395 | 5/1934 | Phillips | 472/95 X |
| 2,719,715 | 10/1955 | Leahan | 472/96 X |
| 4,988,300 | 1/1991 | Yamaguchi et al. | 472/97 X |
| 5,531,645 | 7/1996 | Collins | 472/97 |

FOREIGN PATENT DOCUMENTS

| | | | |
|---|---|---|---|
| 2670127 | 6/1992 | France | 472/95 |

*Primary Examiner*—Kien T. Nguyen
*Attorney, Agent, or Firm*—Locke Purnell Rain Harrell, P.C.; Monty L. Ross

[57] ABSTRACT

A free standing coin operated game system includes a computer and a mechanical animal for a player to ride. The game further includes a first video display screen displaying computer generated video graphics of a moving head section of an animal of the same species as the mechanical animal. The first screen is disposed in front of the mechanical animal and viewable by the player. A second video display screen displays the score of the player. A third video display screen displays computer generated video graphics of an animal of the same species as the mechanical animal and a mounted rider on the animal. During play of the game, movement of the head section image in relation to the surrounding arena images creates a sensation of movement in the player. The video graphics image displayed on the first video display screen induces physical movement by the player who is positioned on the back of the mechanical bull. The mechanical bull is mounted on a rocker which allows for side to side movement by the mechanical bull. Movement by the player in response to the video graphics images on the first display screen will result in physical movement of the mechanical bull.

18 Claims, 5 Drawing Sheets

H
12
88
93
82
98
$W_T$
96
92
86

91
90
80

$W_1$
$W_2$
83
84
81
85
87
θ

RODEO GAME SYSTEM

RELATED APPLICATION

This invention claims priority from Provisional application Ser. No. 60/022,323, filed on Jul. 24, 1996.

TECHNICAL FIELD

This invention relates to games and, more particularly, to an interactive game combining a mechanical ride with a computer generated video graphics display.

BACKGROUND AND SUMMARY OF THE INVENTION

Prior art mechanical bull and bucking bronco rides are well known in the art. Interactive video games for home and arcade use are well known in the art. The present invention comprises a unique game system combining a mechanical ride with a computer generated video graphics display.

The free standing coin operated game system of the present invention includes a computer and a mechanical bull for a player to ride. The game further includes a first video display screen displaying computer generated video graphics of an image of a head section of a bull with movement of the head section in relation to an image of a rodeo arena. The first display screen is disposed in front of the mechanical animal and viewable by the player. Movement of the head section image in relation to the surrounding arena images creates a sensation of movement in the player.

The game includes a second video display screen for displaying the computer generated score of the player. A third video display screen displays computer generated video graphics of a bull, a rider mounted on the bull and a rodeo arena.

During play of the game, the video graphics image displayed on the first video display screen induces physical movement by the player who is positioned on the back of the mechanical bull. The mechanical bull is mounted on a rocker which allows for side to side movement by the mechanical bull. Movement by the player in response to the video graphics images on the first display screen will result in physical movement of the mechanical bull.

The game further includes various sensors that communicate the players movements to the computer. A hand grip is movably mounted on the back of the mechanical animal. Included in the hand grip is a sensor connected to the computer, wherein the computer terminates a first portion of the game when the sensor in the hand grip indicates the player has lost contact with the hand grip. A plurality of sensors are positioned on the right and left side of the torso of the mechanical animal, wherein the computer terminates the first portion of the game when the sensors indicate both of the legs of the player have lost contact with the torso of the mechanical animal. Additional sensors are positioned on the right and left side of the mechanical animal, wherein the computer terminates the first portion of the game when the sensors indicate the mechanical bull has moved a preselected maximum distance to its right or left side.

The game includes a first mechanical ride portion wherein the player rides the mechanical bull with his actions and movements induced by the video graphic image of the bull's head and rodeo area displayed on the first video screen. The ride portion is terminated by the computer based on input data from the sensors which indicate the player's actions simulate being "thrown" from the bull. (In actuality, for safety purposes, the rider is belted in place and is not thrown from the mechanical bull). Points are earned by the player depending on the length of time the player is able to ride without being "thrown". Points may be deducted when the torso sensors indicate one of the player's legs loses contact with the torso. Following termination of the ride portion of the game, a second video escape portion of the game is displayed on the third display screen. In the interactive escape portion of the game, the player uses a powerball controller and jump button mounted on the neck of the mechanical bull to direct a video graphic image of a thrown bull rider attempting to escape from a video graphic image of the bull. Points may be scored by the player for a successful escape by the rider from the arena.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
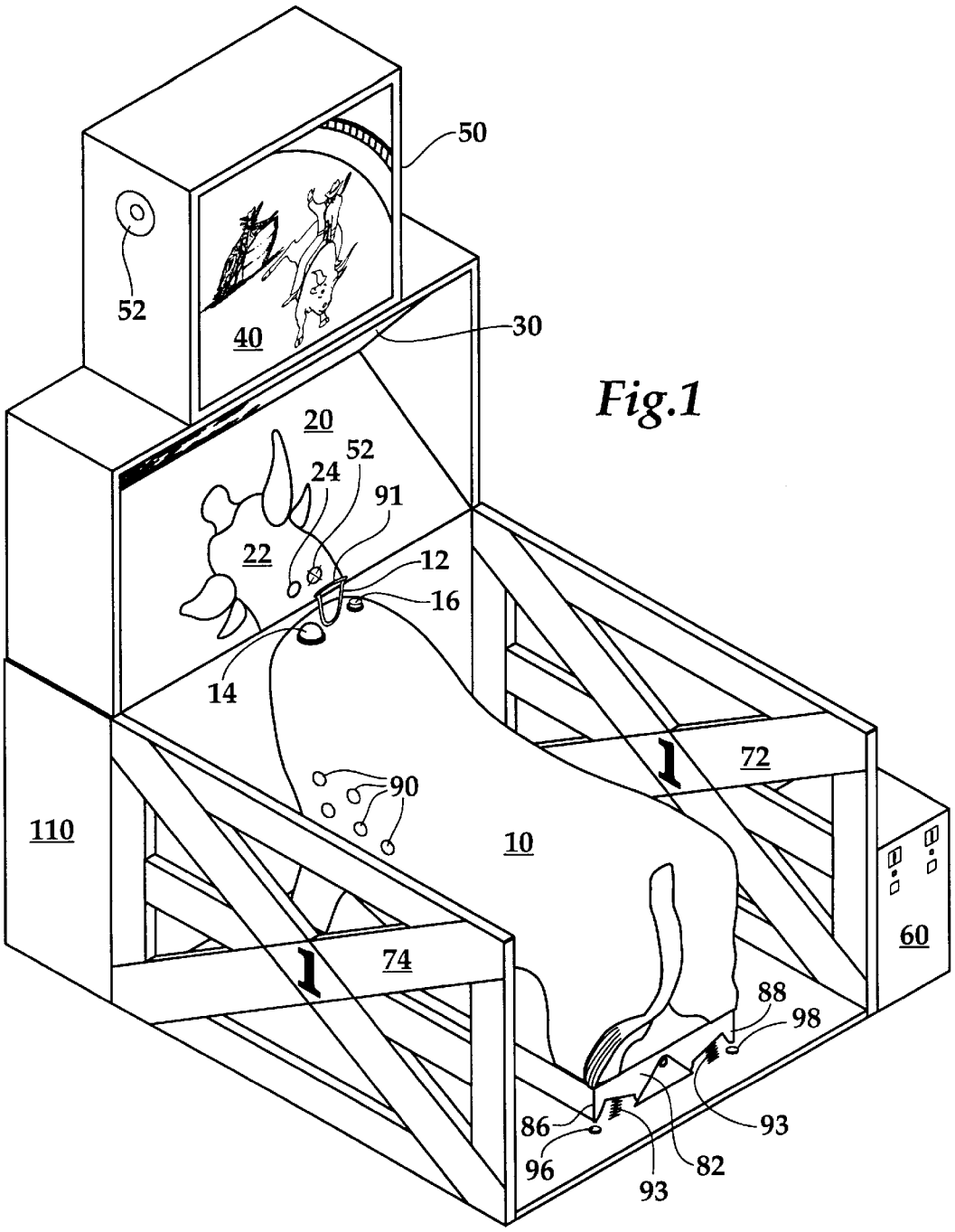
FIG. 1 is a perspective view of the interactive rodeo game system of the present invention.

Reference is now made to the Drawings wherein like reference characters denote like or similar parts throughout the Figures. Referring to FIG. 1, therein is illustrated a perspective view of the game of the present invention. The rodeo game system 100 is a unique combination of a mechanical bull 10 with an interactive video graphics and sound display system comprising a rider display screen 20 for displaying video graphics of a moving head section of a bull, a scoring display screen 30 illustrating the scoring of the player during the game 100, and a spectator/escape video display screen 40 displaying video graphics of a clown, bull and rider moving about a rodeo arena. Screens 20, 30 and 40 and a computer ("CPU") 110 are mounted in a cabinet 50. Speakers 52 for providing sound accompanying the video graphics are included in cabinet 50.

Figure 2:
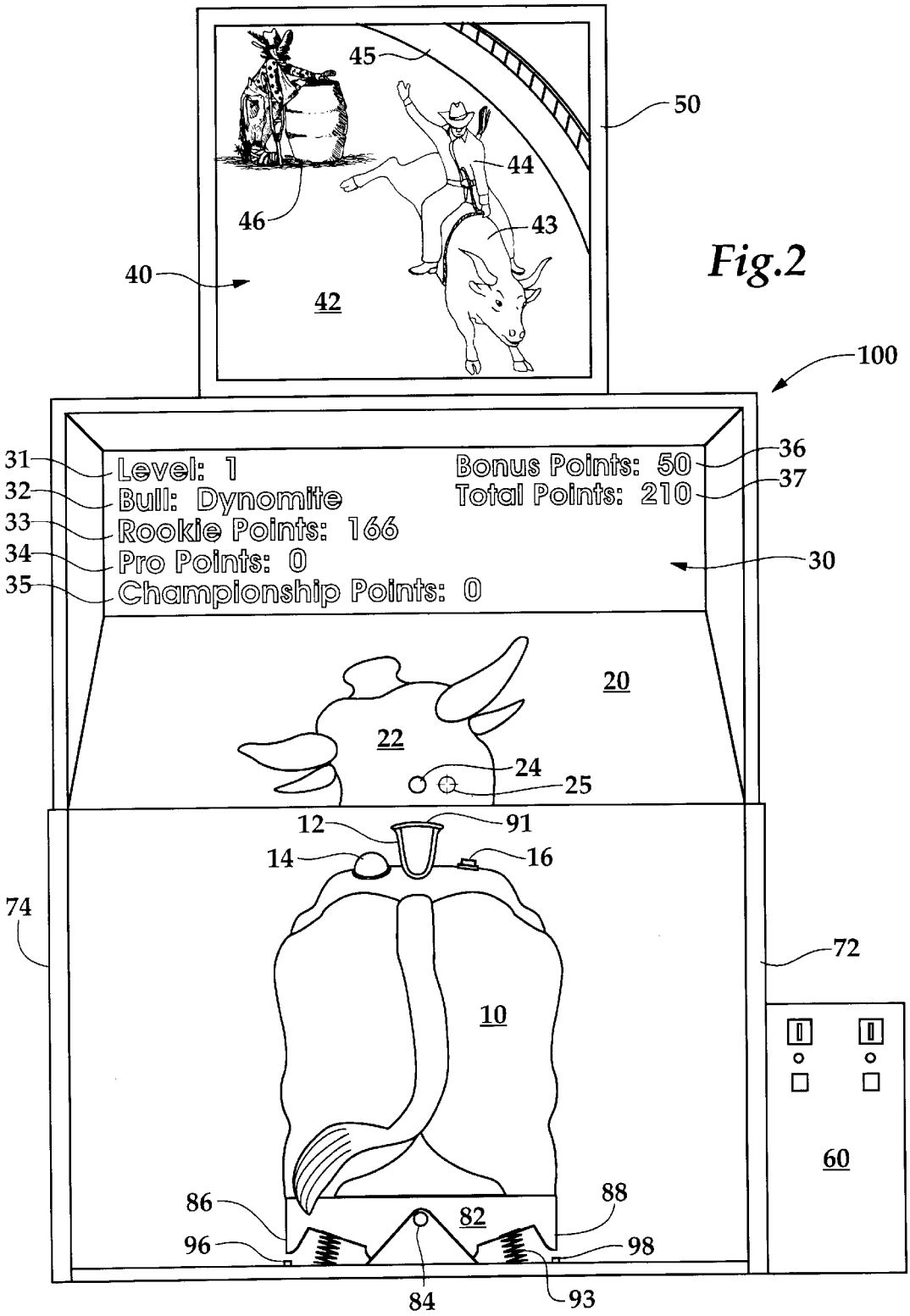
FIG. 2 is an end view of the game of FIG. 1.

Referring now to FIG. 2, the rider screen 20 is disposed generally in line with the prospective location of a head of the mechanical bull 10 were the bull to actually have a physical head. Computer generated video graphic images 22 comprising a head section of a bull with movement about a rodeo arena is displayed during operation of the first portion of the game 100. A focus point 24 located on the video graphics image 22 of the neck of the bull assists the player in maintaining his line of sight on the movement of the image of the bull's head, which in turn assists in the player's feel of realism during the mechanical ride. The rider screen 20 is positioned at an angle which also assists the player in focusing his line of sight on the video graphics images 22.

The scoring screen 30 displays such typical items as the level of difficulty of the game 31, the bull's name 32 in the pre-programmed selection, rookie points 33, pro points 34, championship points 35, bonus points 36 and a total ride score 37. The screen 30 may be positioned at an angle forward to prevent glare on the screen from any overhead lighting.

The spectator/escape display screen 40 displays video graphics 42 of a bull image 43 and rider 44, wherein the bull image 43 is illustrated, bucking and moving around in a typical rodeo arena 45. The display screen 40 is positioned in cabinet 50 above screens 20 and 30. This upper position facilitates viewing of video graphics 42 by spectators during play of the game. Movement of the bull image 43 in video graphics 42 is synchronized with movement of the bull's head image in video graphics 22.

The mechanical bull 10 includes a hand grip 12 movably mounted on the back of the mechanical bull 10. The hand grip serves multiple functions. First, it assists the player in keeping his/her balance as the bull 10 rocks from side to side during play of the first portion of the game. Additionally it is connected at the base to a conventional joy stick controller. Movement of the hand grip 12 is transmitted via the joy stick controller to the CPU 110 wherein the CPU 110 generates an image of a cross hair 25 that is displayed in the video graphic 22. The player is instructed to maintain the cross hair 25 on the focus point 24 by movement of the hand grip 12. The hand grip 12 further includes a sensor 91 indicating contact between the player's hand and the grip 12. The sensor 91 may be pressure, optical or infra-red activated as are well known in the art. The mechanical bull preferably further includes additional rider manipulable controls such as a roller ball 14 and a jump button 16 for an escape portion of the game 100, which will be explained in more detail hereinafter.

In the embodiment illustrated in FIGS. 1 and 2, a conventional coin operator 60 as is well known in the art is used to activate the game 100. The coin operator 60 is disposed adjacent to side panels 72 and 74. Alternatively, a conventional encoded card operated system may be used to activate the game. In the preferred embodiment, the game system 100 is free standing and coin operated. However, it will be understood by those skilled in the art that in an alternative embodiment the game 100 may be activated by an attendant with a conventional on/off switch. The game 100 is open on the rear end for access by the player to the mechanical bull 10.

Figure 3:
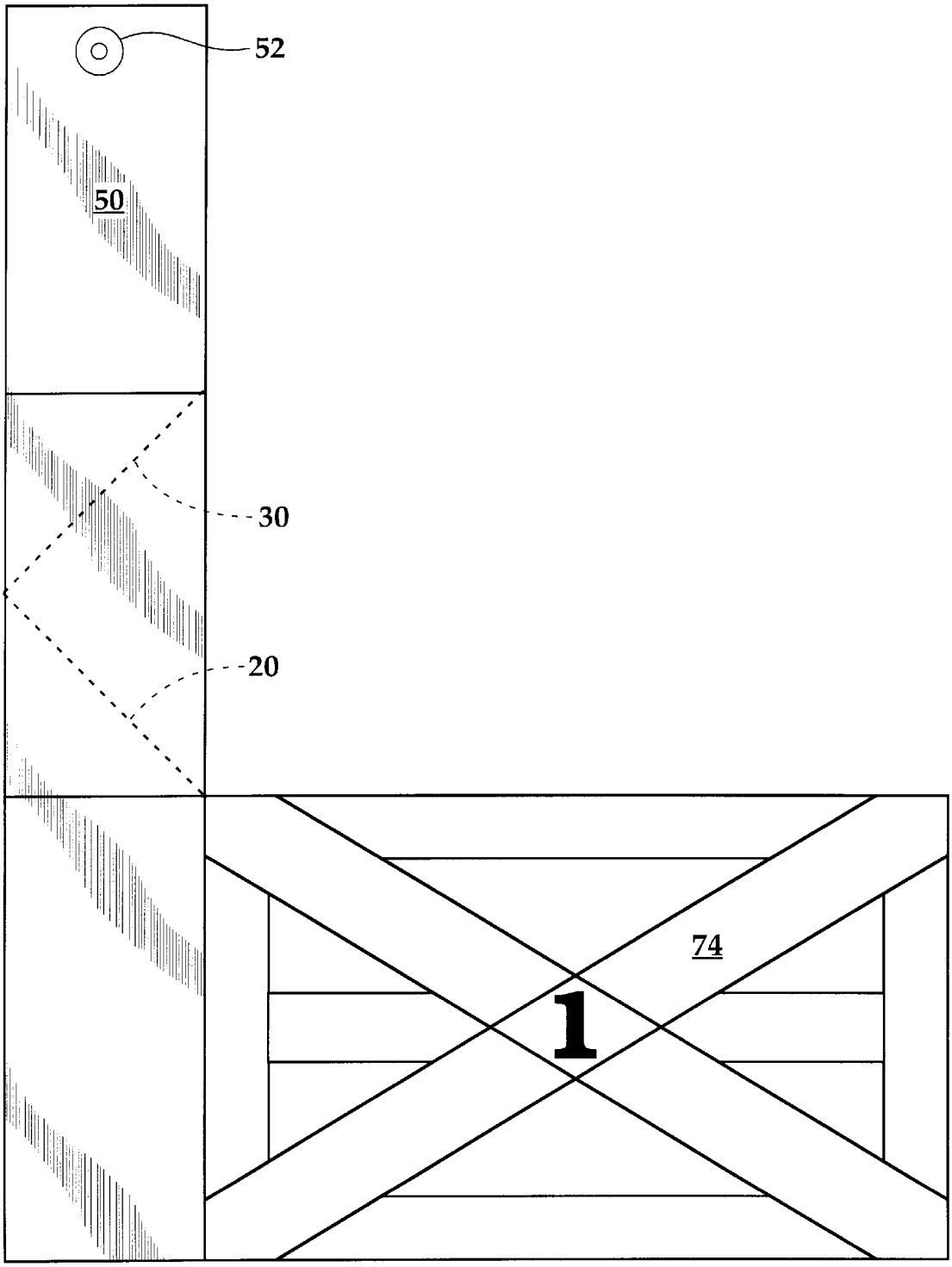
FIG. 3 is a side view of the game of FIG. 1.

Referring now to FIG. 3, therein is illustrated a side view of the game 100. The side panel 72 is illustrated as a continuous panel with a standard rodeo chute gate imprinted thereon. It will be understood that an actual hinged bar gate may be used for side access to the game as opposed to rear access. The rider screen 20 in cabinet 50 is illustrated in phantom as being disposed back and away from the front of cabinet 40 at approximately a 45 degree angle and the scoring screen 30 is illustrated in phantom as being disposed forward away from the back of the cabinet 50 at approximately a 45 degree angle. The spectator screen 40 is positioned above screens 20 and 30.

Figures 4, 5, 6, 7:
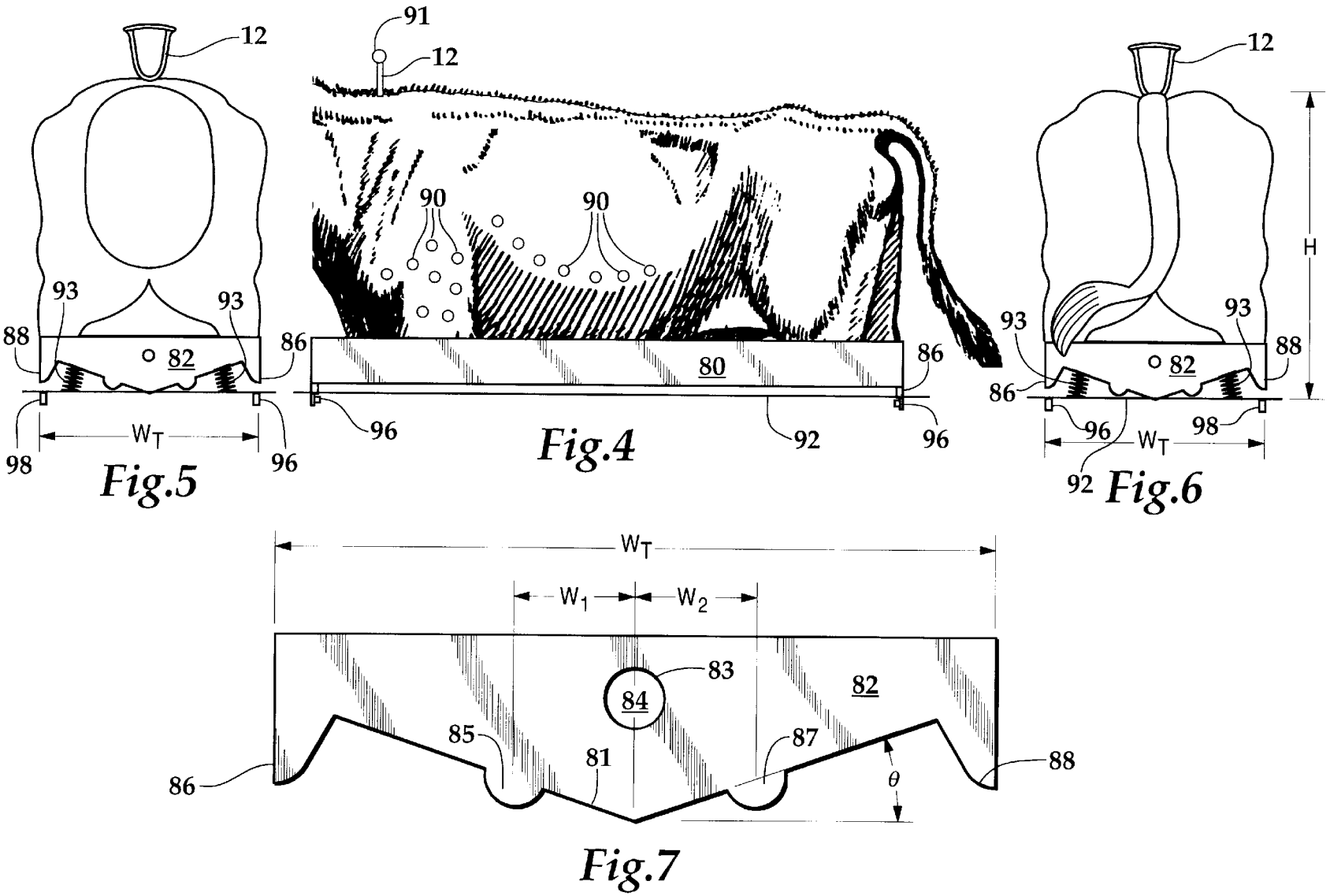
FIG. 4 is a side view of a mechanical animal component of the present invention.
FIG. 5 is a front view of the mechanical animal of FIG. 4.
FIG. 6 is a rear view of the mechanical animal of FIG. 4.
FIG. 7 is an enlarged partial rear view of the rocker support for the mechanical animal of FIG. 6.

Referring now to FIG. 4, therein is illustrated a side view of the mechanical bull 10. The bull 10 includes a plurality of sensors 90 that indicate contact between the player's legs and the torso of the mechanical bull 10 during the first ride portion of the game 100. The sensors 90 may be pressure, optical or infra-red activated as are well known in the art. The mechanical bull 10 is mounted to a rocker frame 80. The preferred length L of the bull 10 is about 5 feet 6 inches. FIG. 5 illustrates a front view of the bull 10 and one of a plurality of substantially identical rockers 82 positioned in rocker frame 80. FIG. 6 illustrates a rear view of the bull 10 and another of the rockers 82. The preferred width $W_T$ of a rocker 82 is about 2 feet. The preferred height H of the bull 10 is about 3 feet. It will be apparent to those skilled in the art that in the embodiment illustrated the rocker frame 80 and rockers 82 allow side to side or rolling movement by a player positioned on mechanical bull 10, but do not allow any forward or backward movement (i.e. movement is provided for in a lateral direction about a longitudinal axis of the bull). However, it will be understood that the frame 80 may be configured with a rocking mechanism allowing for movement along the longitudinal axis of the bull.

Referring now to FIG. 7, therein is an enlarged view of a rocker 82. The rocker 82 includes a central opening 83 for connection to a pivot bar 84 supported in a conventional manner. Preferably the rocker includes a "V" shaped bottom 81 with a first contact point 85 spaced a distance about $W_1$=4 inches to the left of the center of bottom 81 and a second contact point 87 a distance about $W_2$=4 inches to the right of center. Each side of the "V" shaped bottom is disposed at angle e ranging from about 15 to 55 degrees from horizontal. The contact points 85 and 87 comprise a curvalinear protrusion from the "V" shaped bottom 81. On the distal end of each side of the "V" shaped bottom 81 is a third contact point 86 and fourth contact point 88. The third and fourth contact points 86 and 88 preferably comprise a curvalinear shaped protrusion. Referring to FIGS. 1 and 6, when a player on the ride moves to the left, the first contact 85 strikes the floor 92 and provides a soft bucking action and as the movement continues to the left the third contact point 86 strikes a sensor 96 in the floor. Likewise, when a player on the ride moves to the right, the second contact 87 strikes the floor 92 and provides a soft bucking action and as the movement continues to the left the fourth contact point 88 strikes a sensor 98 in the floor. Springs 93 and 94 accentuate the bucking movement. In the embodiment disclosed herein, the mechanical animal the game player rides is illustrated as a bull. However, it will be understood by those skilled in the art that a bucking bronco or other animal figure may be used in conjunction with associated video graphics and sound of the selected animal.

Figure 8:
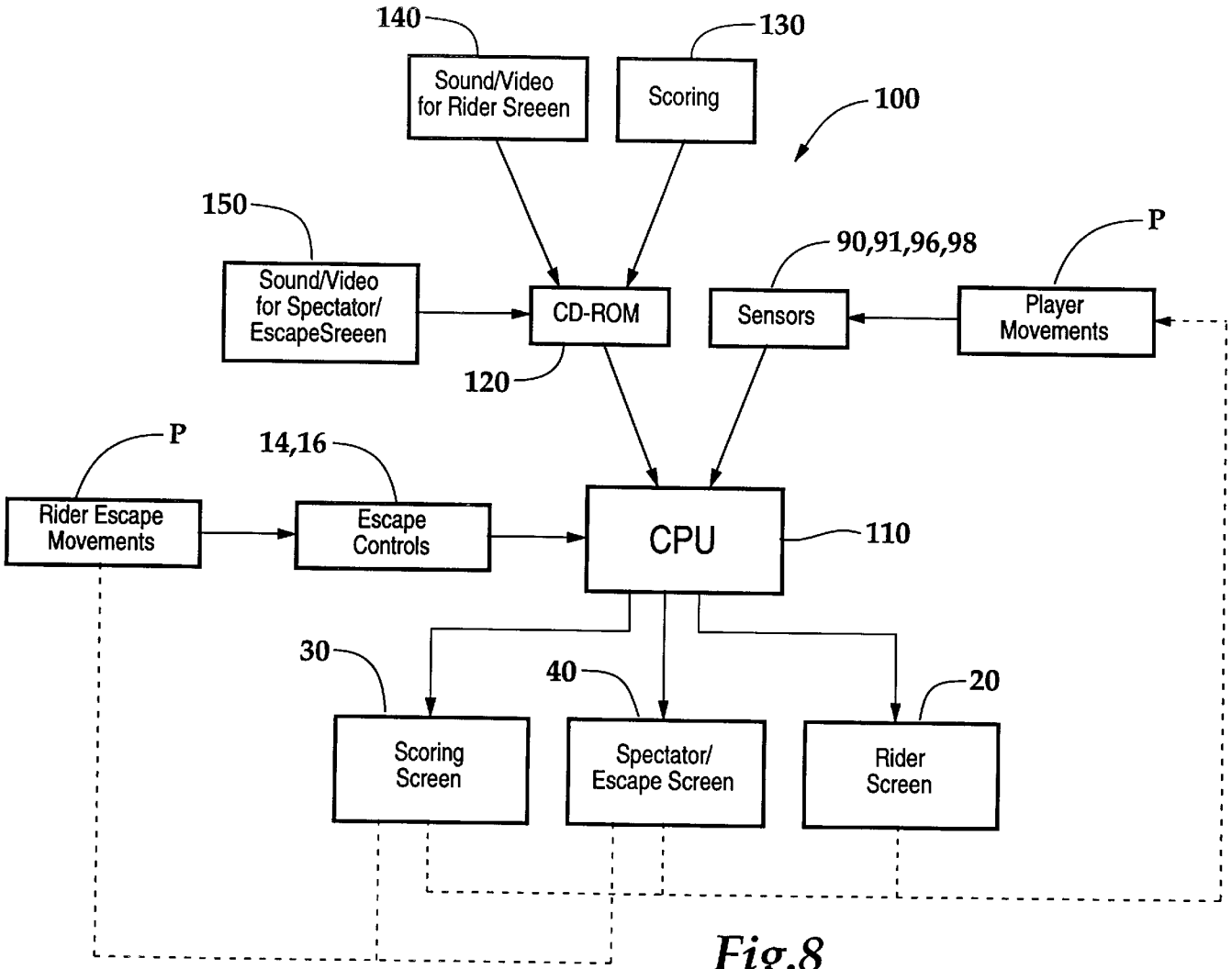
FIG. 8 is a block diagram illustrating the interaction of the major component parts of the rodeo game system of the present invention.

Referring now to FIG. 8, therein is a block diagram illustrating the interaction of the major components of the rodeo game system 100. The computer ("CPU") 110 retrieves stored information from a CD ROM 120 (or similar storage device). The stored information includes pre-recorded sound and video graphic movements 140 for display screen 20 and pre-recorded sound and video graphic movements for display screen 40 and preprogrammed scoring parameters 130 for display screen 30. The CD ROM reader 120 (or a similar reader device) provides versatility to the game system 100. The pre-programmed sound and graphics may be changed periodically without a major retrofit of the machine, thereby keeping repeat player interest in the game system 100. It will be understood by those skilled in the art that a CD ROM reader 120 is not necessary for practice of the present invention. The CPU may include internal memory for storing the preprogrammed sound, graphics and other necessary parameters for operation of the game 100.

During play of the game 100, the CPU 110 will retrieve preprogrammed data 130, 140 and 150 from the CD ROM 120. The CPU 110 generates and transmits three groups of separate but coordinated sound and video signals: a first signal comprising sound and video graphics of a moving head of a bull transmitted to the rider screen 20 and speakers 52; a second signal comprising the score of the player transmitted to the scoring display screen 30; and a third signal comprising sound and video graphics of a bull and a rider moving about a rodeo arena transmitted to the spectator/escape video display screen 40 and speakers 52.

The game 100 includes two distinct portions. A first ride portion wherein the player rides the mechanical bull with his actions and movements induced by the video graphic images 22 displayed on the first video screen 20. During play, the player is instructed to mount the mechanical bull and keep both legs in contact with the sensors 90 on each side of the torso of the mechanical bull 10. If the sensors detect that both of the rider's legs have lost contact with the bull, the CPU terminates the ride portion of the game 100. The player is instructed to grab the grip 12 with one hand thereby activating sensor 91 and instructed not to release the grip 12 during the ride. If the player releases the grip 12, the game considers the player has been thrown from the bull and terminates the ride portion of the game and proceeds directly to an escape portion. The mechanical bull is not perfectly balanced and will tend to fall under its own weight to the right or left side. The player is instructed to maintain his balance and not allow the bull to become off balance to a degree that the contacts 86 or 88 strike floor sensors 96 and 98. If the sensors 96 or 98 are contacted by the rocker 82 the ride portion of the game is terminated and the game moves to the escape portion.

During the ride portion of the game, the player is instructed to focus on the point 24 on the neck of the bull in the video graphics 22 displayed on the rider screen 20 and to maintain the cross hair 25 on the focus point 24 by moving the hand grip 12.

During the ride portion of the game, the spectator screen 40 displays video graphics of a bull image 43 with rider 44 and clown 42 moving about a rodeo arena 45. Movement of the bull image 43 corresponds to movement of the image of the bull's head 22 in video graphics of the rider screen 20. During the ride portion, the spectator screen 40 is intended to be viewed by spectators and creates excitement and interest for future players of the game 100.

As indicated in FIG. 8, a player receives stimulation from rider screen 20, scoring screen 30, and spectator screen 40. The player's movements in reaction to the stimulation are sensed by sensors 90, 91, 96 and 98.

During the ride portion, sound and video graphics include three levels of difficulty. Within each level of difficulty is a selection of eight different bulls and their associated different pre-programmed mechanical movements, video graphics and sound. In the first two levels, the pre-programmed movements, video graphics and sound are not modified by input data from the sensors 90. The ride portion of the game is merely terminated if the CPU receives data from any of the sensors 90, 91, 96 or 98 which indicates the player has been thrown from the bull. (For safety reasons, the player riding the mechanical bull 10 will not have actually been thrown from the bull 10 and the game may include a safety belt to restrain the player on the bull 10.)

If a player progresses through levels one and two without being thrown as indicated by the sensors 90, 91, 96 and 98, the player enters level three, the interactive phase of the ride portion. In level three, input data from leg position sensors 90 is processed by the CPU and used to modify the preprogrammed graphic images 22 on the display screen 20 and graphic images 42 on display screen 40. If a leg sensor 90 indicates that the player's right leg has lost contact with the right side of the animal, it is likely indicative that the player is off balance and leaning to the left. The display screens 20 and 40 will display the bull image 43 circling and bucking to the right side in an attempt to "throw" the off-balance player.

If sensors 90, 91, 96 or 98 indicate the rider is "thrown," the player moves to the escape portion of the game 100. In the escape portion, the player is instructed to direct his attention to the spectator/escape screen 40, power ball 14 and jump button 16. The pre-programmed video graphics 42 will illustrate a rider 44 as dismounted from the bull image 43 in the bull arena 45 with the clown 46. The goal of this portion of the game is to escape from the rodeo arena 45 by jumping over the arena wall. Movement of the dismounted rider 44 will be controlled by the power ball 14. The faster the ball is moved the faster the rider will run. The bull image 43 will be programmed to attempt to butt, gore or trample the rider 44. The rider 44 may escape temporarily into the barrel with clown 46 by use of the jump button 16, if the rider is proximal to the clown's barrel. If the barrel overturns, the rider 44 must escape to the wall of the arena 45 or be trampled by the bull image 43. If the rider 44 is trampled, he will be injured and will be handicapped in the next ride portion of the game. The handicap limits the maximum points that may be earned in the next round. The handicap may be removed in the escape portion of the ride if the rider image 44 contacts a clown image 46 or jumps in the clown's barrel or jumps over the rodeo arena fence at a designated first aid station.

As illustrated in FIGS. 2 and 8, the CPU calculates scoring and awards rookie points for a level 1 ride, pro points for a level 2 ride and championship points for a level 3 ride. Points are awarded for not being "thrown" bull during the predetermined length of the ride. Points are deducted when one of the legs loses contact with the sensors 90. As previously discussed, the rider 44 is considered thrown and the ride portion terminated if both legs lose contact with sensors 90. In the escape portion of the game 100, bonus points are awarded for a safe exit over the arena wall.

Although a preferred embodiment of the invention has been illustrated in the accompanying Drawings and described in the foregoing Detailed description, it will be understood that the invention is not limited to the embodiment disclosed but is capable of numerous modifications without departing from the scope of the invention as disclosed.

I claim:

1. A game system comprising:

a computer;

a mechanical animal capable of movement when ridden by a player;

a first video display screen displaying video graphics of a moving head section of an animal of the same species as the mechanical animal, said video graphics generated by the computer, said first screen disposed in front of the mechanical animal and viewable by the player, wherein the video graphics image displayed creates a sensation of movement by the player viewing the first video display screen and induces physical movement by the player who is positioned on the mechanical animal;

a second video display screen displaying video graphics of an animal of the same species as the mechanical animal and a rider on the animal, wherein said animal and rider being displayed move together; and wherein movement by the player in response to the video graphics images on the first display screen will result in physical movement of the mechanical animal and creating the sensation of a ride by the player.

2. The game system of claim 1 further including a hand grip mounted on the mechanical animal, said grip having a sensor connected to the computer and wherein the computer terminates the ride when the sensor in the hand grip indicates the player has lost contact with the hand grip.

3. The game of claim 1 further including a plurality of sensors positioned on the right and left side of a torso of the mechanical animal, said sensors connected to the computer, wherein the computer terminates the ride when the sensors indicate both of the legs of the player have lost contact with the torso of the mechanical animal.

4. The game system of claim 1 further including a plurality of sensor positioned on the right side of the mechanical animal and a sensor positioned on the left side of the mechanical animal, said sensors connected to the computer, wherein the computer terminates the ride when the sensors indicate the mechanical animal has moved a preselected maximum distance to its right or left side.

5. The game system of claim 1 further including a rocker mounted to the mechanical animal allowing for movement to the left side and right side of the mechanical animal, said rocker having:

a "V" shaped bottom wherein each side of the "V" is disposed at an angle from horizontal;

a central opening for connection to a pivot bar thereby allowing partial rotation of the rocker;

a first contact point comprising a curvalinear protrusion on a left side of the bottom of the "V";

a second contact point comprising a curvalinear protrusion on a right side of the bottom of the "V";

wherein when the mechanical animal moves to the left the first contact point strikes a stop and provides a bucking action and when the mechanical animal moves to the right the second contact point strikes a stop and provides a bucking action.

6. The game system of claim 5 wherein the rocker further includes:

a third contact point disposed at the left distal end of the bottom of the "V";

a fourth contact point disposed at the left distal end of the bottom of the "V";

a first sensor position ed below the mechanical animal and the third contact point of the rocker, wherein when the third contact point contacts the first sensor the computer terminates the ride; and a second sensor positioned below the mechanical animal and the fourth contact point of the rocker, wherein when the fourth contact point contacts the second sensor the computer terminates the ride.

7. The game system of claim 1 further including a CD ROM reader connected to the computer, said CD ROM reader for reading stored data comprising pre-programmed video graphics, sound and scoring routines and transferring said data to the computer.

8. A game system comprising:

a computer;

a mechanical animal capable of movement when ridden by a player;

a first video display screen displaying video graphics of a moving head section of an animal of the same species as the mechanical animal, said video graphics generated by the computer, said first screen disposed in front of the mechanical animal and viewable by the player, wherein the video graphics image displayed creates a sensation of movement by the player viewing the first video display screen and induces physical movement by the player who is positioned on the mechanical animal;

a second video display screen displaying the score of the player generated by the computer;

a third video display screen displaying video graphics of an animal of the same species as the mechanical animal and a rider on the animal, wherein said animal and rider being displayed move together; and wherein movement by the player in response to the video graphics images on the first display screen will result in physical movement of the mechanical animal and creating the sensation of a ride by the player.

9. The game system of claim 8 further including a hand grip mounted on the mechanical animal, said grip having a sensor connected to the computer and wherein the computer terminates the ride when the sensor in the hand grip indicates the player has lost contact with the hand grip.

10. The game of claim 8 further including a plurality of sensors positioned on the right and left side of a torso of the mechanical animal, said sensors connected to the computer, wherein the computer terminates the ride when the sensors indicate both of the legs of the player have lost contact with the torso of the mechanical animal.

11. The game system of claim 8 further including a plurality of sensor positioned on the right side of the mechanical animal and a sensor positioned on the left side of the mechanical animal, said sensors connected to the computer, wherein the computer terminates the ride when the sensors indicate the mechanical animal has moved a preselected maximum distance to its right or left side.

12. The game system of claim 8 further including a rocker mounted to the mechanical animal allowing for movement to the left side and right side of the mechanical animal, said rocker having:

a "V" shaped bottom wherein each side of the "V" is disposed at an angle from horizontal;

a central opening for connection to a pivot bar thereby allowing partial rotation of the rocker;

a first contact point comprising a curvalinear protrusion on a left side of the bottom of the "V";

a second contact point comprising a curvalinear protrusion on a right side of the bottom of the "V";

wherein when the mechanical animal moves to the left the first contact point strikes a stop and provides a bucking action and when the mechanical animal moves to the right the second contact point strikes a stop and provides a bucking action.

13. The game system of claim 12 wherein the rocker further includes:

a third contact point disposed at the left distal end of the bottom of the "V";

a fourth contact point disposed at the left distal end of the bottom of the "V";

a first sensor positioned below the mechanical animal and the third contact point of the rocker, wherein when the third contact point contacts the first sensor the computer terminates the ride; and a second sensor positioned below the mechanical animal and the fourth contact point of the rocker, wherein when the fourth contact point contacts the second sensor the computer terminates the ride.

14. The game system of claim 8 further including a CD ROM reader connected to the computer, said CD ROM reader for reading stored data comprising pre-programmed video graphics, sound and scoring routines and transferring said data to the computer.

15. The game of claim 8 further including at least one speaker for projecting preprogrammed sounds accompanying movement of the video graphics being simultaneously displayed on the video display screens.

16. The game system of claim 8 further including a coin operated activator.

17. The game system of claim 8 further including an encoded card activator.

18. A game system comprising:

a computer;

a mechanical animal capable of movement when ridden by a player;

a first video display screen displaying video graphics of a moving head section of an animal of the same species as the mechanical animal with a focus dot on the moving head section, said video graphics generated by the computer, said first screen disposed in front of the mechanical animal and viewable by the player, wherein the video graphics image displayed creates a sensation of movement by the player viewing the first video display screen and induces physical movement by the player who is positioned on the mechanical animal;

a hand grip mounted on the mechanical animal, said grip connected to a joy stick controller connected to the computer, wherein movement of said grip directs a computer generated a target image in the video graphics image on the moving head section of the animal;

a second video display screen displaying the score of the player generated by the computer;

a third video display screen displaying video graphics of an animal of the same species as the mechanical animal and a rider on the animal, wherein said animal and rider being displayed move together; and wherein movement by the player in response to the video graphics images on the first display screen will result in physical movement of the mechanical animal and creating the sensation of a ride by the player.

* * * * *